United States Patent [19]

Hasegawa et al.

[11] Patent Number: 4,813,812

[45] Date of Patent: Mar. 21, 1989

[54] SLOPING BLOCKS AND REVETMENT STRUCTURE USING THE SAME

[75] Inventors: Minoru Hasegawa, Tsukuba; Norichika Hamaguchi, Tsuchiura, both of Japan

[73] Assignee: Nippon Tetrapod Co. Ltd., Tokyo, Japan

[21] Appl. No.: 162,638

[22] Filed: Mar. 1, 1988

[30] Foreign Application Priority Data

Mar. 17, 1987 [JP] Japan ..... 62-59926

[51] Int. Cl.[4] ..... E02B 3/14

[52] U.S. Cl. ..... 405/16; 52/608; 405/20

[58] Field of Search ..... 405/15, 16, 17, 19, 405/20; 52/603, 604, 608; 404/37, 38, 39, 41

[56] References Cited

U.S. PATENT DOCUMENTS 1,164,707 12/1915 Edinger ..... 405/20
1,164,708 12/1915 Edinger ..... 405/20
4,465,398 8/1984 Knudsen ..... 405/16

FOREIGN PATENT DOCUMENTS 2123523 11/1972 Fed. Rep. of Germany ..... 405/20

*Primary Examiner*—David H. Corbin

*Attorney, Agent, or Firm*—Frishauf, Holtz, Goodman & Woodward

[57] ABSTRACT

A stair-like revetment structure is formed by using sloping blocks. At the rear end of the block main body having an approximately rectangular and a rearwardly sloping flat step are provided rear engagement pods opening like a wedge at the rear of the main body and front engagement pods having an approximately same shape as the rear engagement pods extending adjacent a concave portion at the center bottom of the front of the main body, the concave portion being provided between the front and the rear engagement pods. This results in a low cost simplified sloping block structure. The thus structured sloping blocks are arranged next to each other on a sloping foundation, the front engagement pods of the sloping blocks of one layer being inserted into an engagement concave portion between the rear engagement pods of the adjacent block to successively cover the sloping foundation in a zig-zag and step-wise fashion, to thereby form a water passage with the concave portion of the upper layer sloping blocks and the engagement concave portion formed between the rear engagement portion of the sloping blocks of one layer below. The revetment structure can secure the safety of users since there are no exposed projections, holes, etc. on the stair-like steps.

10 Claims, 4 Drawing Sheets

SLOPING BLOCKS AND REVETMENT STRUCTURE USING THE SAME

BACKGROUND OF THE INVENTION AND RELATED ART STATEMENT

The present invention concerns a sloping block, and more particularly to a stair-like revetment structure using said sloping blocks and which is generally referred to as a water-friendly revetment.

In the prior art, revetments structured for the coastal areas and rivers are usually of the vertical type as the disaster prevention functions are regarded the most important. However, there are proposed recently many revetment structures where the environmental aspect is given increased importance to allow people to approach the beaches and the shorelines. Such a revetment structure is called a water-friendly structure.

Such a water-friendly revetment structure has a gently sloped surface made up of a regular combination of blocks having sloped steps. The step of the sloped blocks is, however, provided with notches, holes or indentations for passing the water, thereby complicating the manufacture process and increasing the cost. As the surface of a structure built up with a combination of such sloped blocks had notches, holes or indentations exposed thereon, it was not only dangerous for the general public, especially for infants and elderly, but also created the regular burden of removing dirt, etc. Thus the revetment of this type was inherently defective.

SUMMARY OF THE INVENTION

The present invention aims at simplifying the process of manufacture and decreasing the cost by offering a sloping block comprising a main body which is approximately parallelepiped and has a sloped flat step extending rearward, one or more rear engagement pods opening in a wedge-like fashion at the rear of the main body, and front engagement pods of the same number and approximately the same shape as the rear engagement pods provided at the lower front center of the main body via a concave portion, said concave portion being provided between the rear and the front engagement pods.

It is preferable, in particular, to give one or more than one curves to the front edge of the block main body, and to provide the curved front edge and the front edge of the front engagement pod on an approximately same plane, and to form a spacer at the rear engagement pod continuing from the step having approximately the same dimension as that of the concave portion at the front of the main body.

A plurality of sloped blocks thus molded are first arranged in horizontal layers at the bottom of the sloped foundation, and then laid in subsequently engaged layers toward the top of the foundation. The relation of the sloped blocks arranged along the vertical axis of the sloped foundation is such that into the concave portion formed between the rear engagement pods of the sloping blocks placed in the bottom layer are inserted the front engagement pods of the sloping blocks on the next upper layer, thereby causing the sloped foundation to be covered in a zig-zag and stepped fashion with these sloped blocks. In this case, a water passage is formed by the concave portion of the sloping block of the upper layer and between the rear engagement pods of the blocks of one layer below in order that the thus constructed revetment will have no notches, holes, etc. on the stepped surfaces for passing the water, to thereby ensure safety and facillitate maintenance.

DETAILED DESCRIPTION OF PREFERRED EMBODIMENTS

Figure 1:
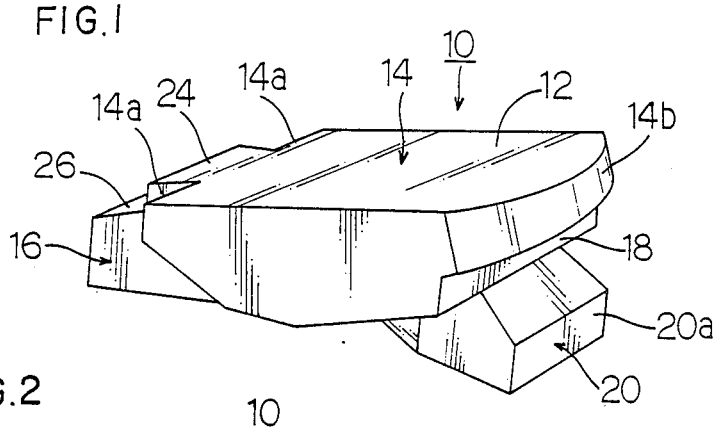
FIG. 1 is a perspective view showing a preferred embodiment of a sloping block according to the present invention.
Figure 2:
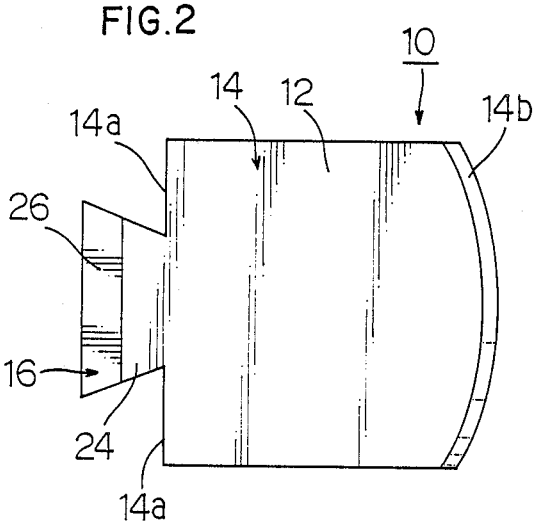
FIG. 2 is a plane view of the sloping block shown in FIG. 1.
Figure 4:
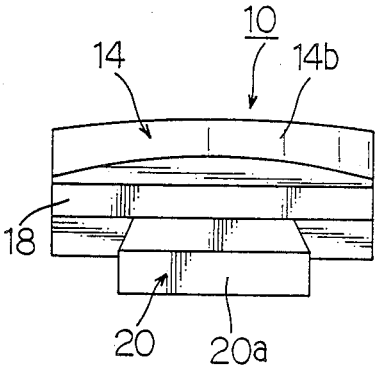
FIG. 4 is a front view of the sloping block shown FIG. 1.

The preferred embodiments of the sloping blocks in accordance with the present invention will now be explained in detail by referring to the attached drawings.

In FIGS. 1 through 6, the sloped block 10 in accordance with this invention comprises a concrete block main body 14 having an approximately rectangular main flat step or main surface portion 12 which is sloping rearwardly, a rear engagement pod 16 extending from the center of the rear edge **14*a* of the main body 14 in a wedge-like fashion, a front engagement pod 20 having approximately the same shape as said rear engagement pod 16 extending adjacent a concave portion 18 at the center bottom at the front of the main body 14, and a bottom concave portion 22 extending upwardly of the main body in the direction perpendicular to the sloping direction of the step or main surface portion 12 between the front engagement pod 20 and the rear engagement pod 16**.

The front edge **14*b* of the main body 14 is curved and the portion which is over most of this curved front edge 14*b* will approximately be on the same plane as the front edge 20*a* of the front engagement pod 20. (See FIG. 1). However, it is not necessary that the front edge 14*b*** should have a curved shape; it may be straight or assume a different curve from that shown in the Figures as need arises.

Figure 3:
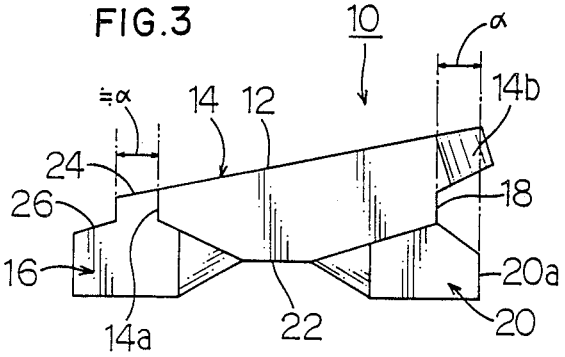
FIG. 3 is a side view of the sloping block shown in FIG. 1.
Figure 5:
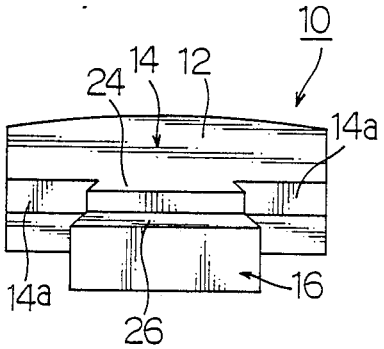
FIG. 5 is a rear view of the sloping block shown in FIG. 1.
Figure 6:
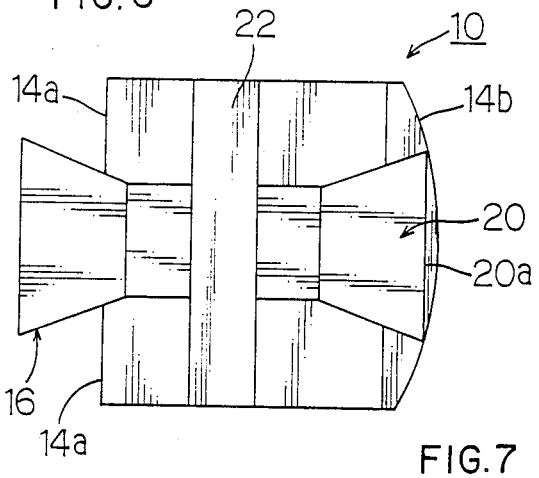
FIG. 6 is a bottom view of the sloping block shown in FIG. 1.
Figure 7:
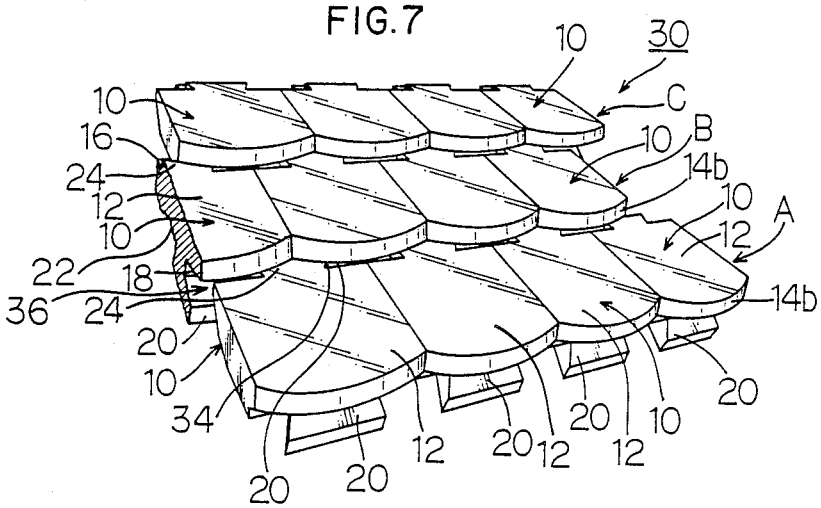
FIG. 7 is a perspective view of a water-friendly stepped revetment structure comprising sloping blocks.
Figure 8:
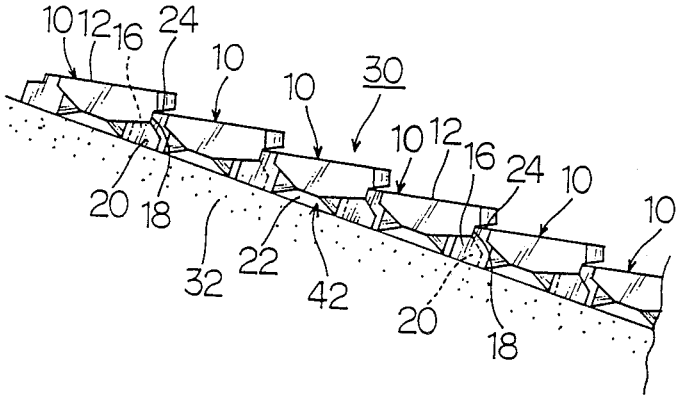
FIG. 8 is an explanatory view showing the side of the water-friendly stepped revetment structure shown in FIG. 7.

At the base of the rear engagement pod 16 continuing from the step 12 of the main body 14 is formed a spacer 24 having approximately the same dimension $\alpha$ as that of the concave portion 18 formed at the front of the main body 14, as seen in FIG. 3. At the rear end of spacer 24 is formed a step 26 which is one step lower than the upper surface of spacer 24.

The sloping block 10 thus constructed has no notches, holes or indentations on the step or upper surface 12 of the main body 14 for passing the water, to thereby simplify the manufacturing process and decrease the manufacturing cost. It is also possible to furnish the step surface and the revetment edge arbitrarily to suit the environment, etc.

Figure 9:
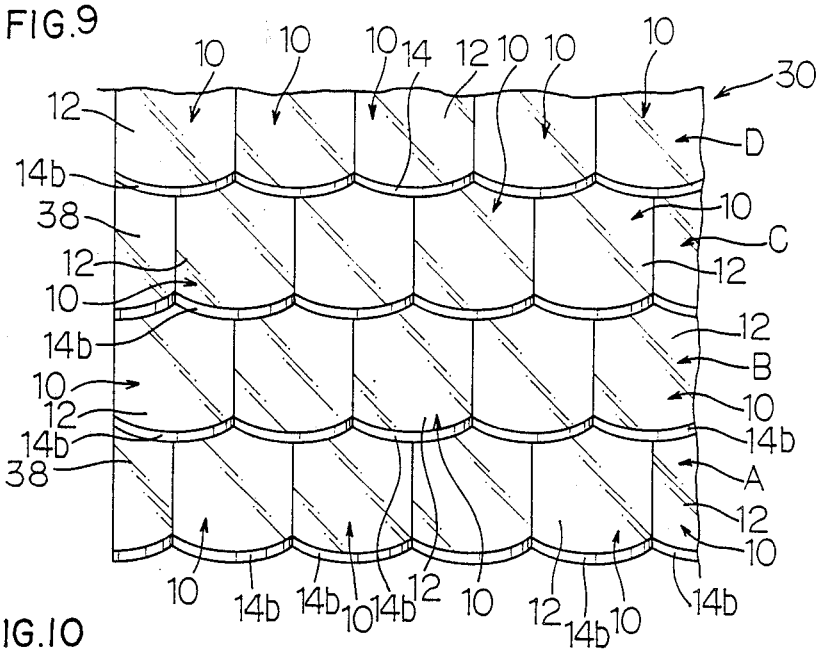
FIG. 9 is a plane view of the water-friendly stepped revetment structure shown in FIG. 7.
Figure 10:
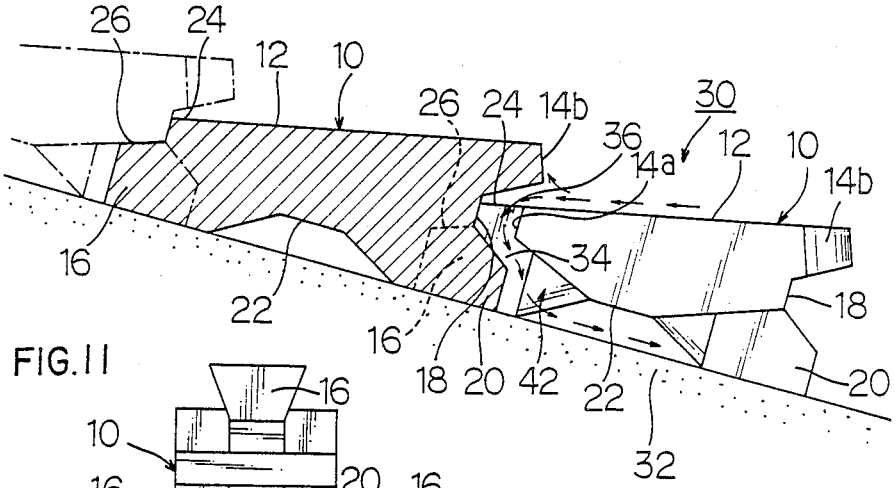
FIG. 10 is an explanatory side view of the sloping blocks in engagement with each other to form the water-friendly stepped revetment structure shown in FIG. 7.
Figure 11:
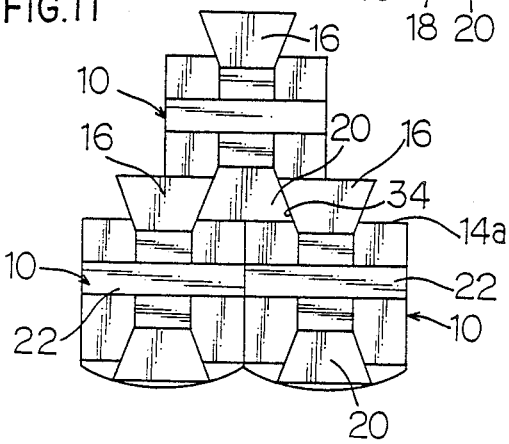
FIG. 11 is an explanatory bottom view for engagement of sloped blocks forming the water-friendly stepped revetment structure shown in FIG. 7.

The water-friendly revetment structure comprised of such sloping blocks thus constructed is now explained. As shown in FIGS. 7 through 11, the water-friendly revetment structure 30 comprises a sloped foundation 32 with a gradient ranging from 1:2 to 1:5 and made up of rubble stones or concrete. A first lower layer A (see FIGS. 7 and 9) comprises horizontally arranged sloping blocks 10 in such a way that the two sides of a step 12 of the respective blocks 10 contact the respective sides of adjacent blocks. A second layer B comprises another set of horizontally arranged sloping blocks 10 of which front engagement pods 20 are inserted into concave portions 34 (see FIGS. 10 and 11) formed between rear engagement pods 16, 16 of the sloping blocks 10, 10 of the adjacent layer A. A third layer C comprises still another set of horizontally arranged sloping blocks 10 of which front engagement pods 20 are inserted into concave portions 34 between the rear engagement pods 16, 16 of the adjacent sloping blocks 10, 10 of the second layer B. The fourth layer D, the fifth layer E, and so forth are successively built in a similar fashion thereby to cover the sloping foundation 32 in a zig-zagging (i.e., interleaved) and step-wise fashion. As shown in FIG. 9, it is preferable to place sloping blocks 38 having a width which is ½ of that of said sloping blocks 10 at the edges of the sloping blocks 10 positioned at sides of the foundation so that the revetment is finished in straight lines.

As the sloping block layers are thus successively engaged with each other, there is formed a water passage 36 inside the front edge of the step 12 of the sloping blocks 10 of the upper layer. The water passage 36 is defined by the concave portion 18 and the concave portion 34 formed between the rear engagement pods 16, 16 of the adjacent sloping blocks 10, 10 of the adjacent layer below. The lower surface of the concave portion 18 of the main body 14 of the upper layer blocks 10 are positioned above a lower step 26 formed on the rear engagement pod 16 of the sloping block 10 of the layer below. There is formed a space by the step 26 and the spacer 24 to prevent the water passage from becoming exposed on the step 12. This is extremely safe for those walking on the revetment. (See FIG. 10).

The passages 36 thus defined communicate with the concave portion 22 at the bottom of the adjacent sloping blocks 10 of the upper and the lower layer and on both sides to form a water path 42.

The water-friendly revetment structure 30 thus constructed maintains stability against the wave actions of the water since the sloping blocks 10 are securely joined both vertically and horizontally as the engagement pods 16, 20 are engaged with the concave member 34. The incoming waves are suitably dissipated by the stair-like structure, flowing back through the water passage 36 and the water path 42 formed by the concave portion 18 at the front edge of the step 12 of the sloping blocks 10 corresponding to the rise of the stairs and the concave portion 34 for engagement, to thereby prevent scouring of the sloping foundation 32 as much as possible.

Figure 12:
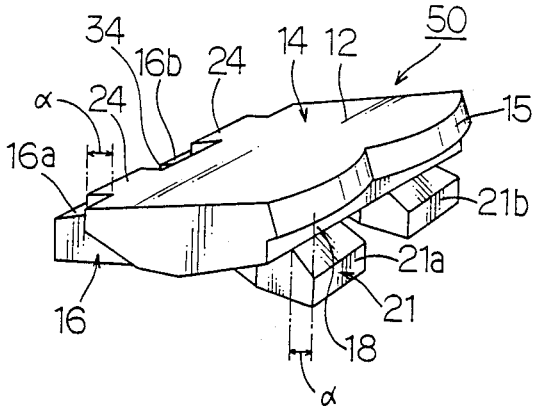
FIG. 12 is a perspective view showing another embodiment of the sloping block according to the present invention.
Figure 13:
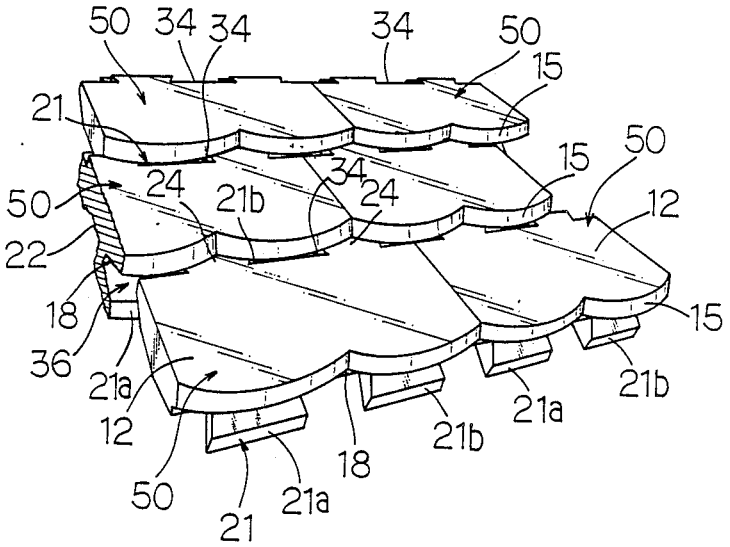
FIG. 13 is a perspective view of the water-friendly stepped revetment structure comprising sloping blocks shown in FIG. 12.

FIG. 12 shows another embodiment of the sloping block 50 according to the present invention; the block 50 comprising a pair of rear engagement pods **16*a*, 16*b* and the frontal engagement pods 21*a*, 21*b* having approximately the same shape and provided to extend from the rear and the front ends of a large block main body 14 having an elongated parallelepiped shape. The front edge of the block main body 14 is formed as a continuous curve, and spacers 23, 23 are formed on the rear engagement pods 16*a*, 16*b* continuing from the step 12 and having approximately the same dimensions as the dimension $\alpha$ of the concave portion 18 at the front to the main body 18, and an engagement concave portion 34 between the rear engagement pods 16*a*, 16*b*. The sloping blocks 50 can maintain stability relative to the installation site by their inherent shape, and the stair-like water-friendly revetment structure using the sloping blocks 50 in a manner similar to tha described for the above embodiment (see FIG. 13**) can reduce the overall costs because of easy installation and engineering.

As discussed heretofore, simplified manufacture of the sloping block according to this invention leads to a remarkable reduction of overall costs, and the edges and steps can be finished arbitrarily to improve the environmental landscape. The revetment structure built with these sloping blocks is not only stable against wave actions but can prevent undesirable scouring for the sloping foundations. Since the structure is free of holes and indentations on the step surfaces, those walking on the structure can be protected from unforeseen danger.

Although the foregoing description was made with respect to preferred embodiments of the sloping blocks and revetment structures built with these blocks according to the present invention, this invention is not to be limited to these embodiments alone. The step portion of the sloping block can be made of water permeable materials to improve water discharge rate, or a portion or all of the steps can be covered by rough faced tiles or colored tiles to enhance the beauty of the sloping blocks or of revetment structure as a whole.

Various changes and modifications in design, etc. can naturally be made within the scope and spirit of this invention such as making the step portion of the sloping blocks water permeable, coloring or covering a portion or all of the steps with rough faces tiles to enhance the beauty of the sloping blocks or of the revetment structure as a whole.

What we claim:

1. A sloping block structure for use in covering an inclined surface, comprising a block main body (14) which includes:

an approximately rectangular main upper surface portion (12) having front and rear portions, said main upper surface portion defining a rearwardly sloping step surface;

a bottom surface portion opposite said main upper surface portion;

at least one rear engagement pod (16) extending from a rear portion of said block main body (14) via a spacer portion (24), said at least one rear engagement pod (16) opening in a wedge-like shape at the rear end of said block main body (14);

at least one front engagement pod (20) provided in the same number and with approximately the same wedge shape as said at least one rear engagement pod (16), and extending from a front portion of said block main body (14) at a lower portion of said block main body below said main upper surface portion, a front concave portion (18) being formed in said front portion of said block main body above said at least one front engagement pod (20) for receiving a spacer portion (24) of another adjacent block structure therein, said first concave portion (18) having a concavity of approximately the same dimensions as said spacer portion (24); and a bottom concave portion (22) in said bottom surface portion of said block main body and positioned between said front (20) and rear (16) engagement pods and extending inwardly of said block main body in a direction substantially perpendicular to the sloping direction of said rearwardly sloping main upper surface portion (12).

2. The sloping block structure of claim 1, wherein:

said block main body has a curved front edge (14*b*) which is formed in at least one curve;

said at least one front engagement pod (20) has a front edge; and said curved front edge (14*b*) of said block main body and said front edge of said at least one front engagement pod (20) are positioned approximately in the same plane.

3. The sloping block structure of clam 1, wherein:

said at least one rear engagement pod extends in the width direction of said block main body over a smaller distance than the overall width of said block main body; and said at least one front engagement pod extends in the width direction of said block main body over a smaller distance than the overall width of said block main body.

4. The sloping block structure of claim 1, wherein said wedge shapes of said front and rear engagement pods are complementary so as to be lockingly interengaging when said block main bodies are arranged adjacent each other.

5. The sloping block structure of claim 1, wherein:

said spacer portion has an upper surface which extends from and is on the same plane as said main upper surface portion (12) of said block main body; and said at least one rear engagement pod (16) has an upper surface (26) which is below the level of said main upper surface portion (12) of said block main body.

6. A revetment structure for covering an inclined surface, comprising a plurality of sloping blocks, each block having a block main body (14) which includes:

an approximately rectangular main upper surface portion (12) having front and rear portions, said main upper surface portion defining a rearwardly sloping step surface;

a bottom surface portion opposite said main upper surface portion;

at least one rear engagement pod (16) extending from a rear portion of said block main body (14) via a spacer portion (24), said at least one rear engagement pod (16) opening in a wedge-like shape at the rear end of said block main body (14);

at least one front engagement pod (20) provided in the same number and with approximately the same wedge shape as said at least one rear engagement pod (16), and extending from a front portion of said block main body (14) at a lower portion of said block main body below said main upper surface portion, a front concave portion (18) being formed in said front portion of said block main body above said at least one front engagement pod (20) for receiving a spacer portion (24) of another adjacent block structure therein, said first concave portion (18) having a concavity of approximately the same dimensions as said spacer portion (24); and a bottom concave portion (22) in said bottom surface portion of said block main body and positioned between said front (20) and rear (16) engagement pods and extending inwardly of said block main body in a direction substantially perpendicular to the sloping direction of said rearwardly sloping main upper surface portion (12);

said sloping blocks being arranged adjacent to one another in rows in the lateral direction of the revetment structure, said sloping blocks being arranged in a zig-zag stair-like fashion over said inclined surface with the front engagement pods of one lateral row of sloping blocks being insertable in respective gap portions formed between adjacent rear engagement pods of another lateral row of sloping blocks, and a water passage being defined by concave portions of an upper lateral row of sloping blocks and said gap portions formed between the rear engagement pods of said sloping blocks of the lateral row which is below said upper lateral row.

7. The revetment structure of claim 6, wherein:

said block main bodies each have a curved front edge (14*b*) which is formed in at least one curve;

said at least one front engagement pod (20) of each block main body has a front edge; and said curved front edge (14*b*) of each said block main body and said front edge of said at least one front engagement pod (20) thereof are positioned approximately in the same plane.

8. The revetment structure of claim 6, wherein:

said at least one rear engagement pod of each block main body extends in the width direction of said block main body over a smaller distance than the overall width of said block main body; and said at least one front engagement pod of each block main body extends in the width direction of said block main body over a smaller distance than the overall width of said block main body.

9. The revetment structure of claim 6, wherein said wedge shapes of said front and rear engagement pods of each block main body are complementary so as to be lockingly interengaging when said block main bodies are arranged adjacent each other.

10. The revetment structure of claim 6, wherein:

said spacer portion of each block main body has an upper surface which extends from and is on the same plane as said main upper surface portion (12) of said block main body; and said at least one rear engagement pod (16) has an upper surface (26) which is below the level of said main upper surface portion (12) of the respective block main body.

* * * * *